US007700873B2

(12) United States Patent
Aumoitte

(10) Patent No.: US 7,700,873 B2
(45) Date of Patent: Apr. 20, 2010

(54) PROTECTIVE SHEATH AGAINST RADIATION, IN PARTICULAR DERIVED FROM ELECTRIC FIELD GENERATED BY ELECTRIC CABLES

(75) Inventor: Christian Aumoitte, Ecquevilly (FR)

(73) Assignee: Rayponse, Ecquevilly (FR)

( * ) Notice: Subject to any disclaimer, the term of this patent is extended or adjusted under 35 U.S.C. 154(b) by 453 days.

(21) Appl. No.: 11/631,504

(22) PCT Filed: Jul. 8, 2005

(86) PCT No.: PCT/FR2005/001766

§ 371 (c)(1),
(2), (4) Date: Jan. 4, 2007

(87) PCT Pub. No.: WO2006/016048

PCT Pub. Date: Feb. 16, 2006

(65) Prior Publication Data

US 2008/0283270 A1 Nov. 20, 2008

(30) Foreign Application Priority Data

Jul. 8, 2004 (FR) ..... 04 07615

(51) Int. Cl.
*H01B 7/00* (2006.01)

(52) U.S. Cl. ..... 174/36

(58) Field of Classification Search ..... 174/102 R, 174/108, 110 R, 113 R, 74 R, 75 R, 78, 84 R
See application file for complete search history.

(56) References Cited

U.S. PATENT DOCUMENTS

| | | | | |
|---|---|---|---|---|
| 3,794,750 | A | 2/1974 | Garshick | |
| 4,499,438 | A * | 2/1985 | Cornelius et al. | 333/1 |
| 4,816,614 | A * | 3/1989 | Baigrie et al. | 174/36 |
| 5,059,747 | A * | 10/1991 | Bawa et al. | 174/655 |
| 5,097,099 | A * | 3/1992 | Miller | 174/36 |
| 5,939,668 | A * | 8/1999 | De Win | 174/36 |
| 6,664,466 | B2 * | 12/2003 | Bailey | 174/36 |
| 6,686,537 | B1 * | 2/2004 | Gareis et al. | 174/36 |
| 6,998,538 | B1 * | 2/2006 | Fetterolf et al. | 174/113 R |
| 2002/0170729 | A1 | 11/2002 | Murakami et al. | |
| 2003/0168242 | A1 * | 9/2003 | Whidden | 174/113 R |
| 2004/0055780 | A1 * | 3/2004 | Hakkarainen et al. | 174/120 R |
| 2005/0001780 | A1 * | 1/2005 | Aisenbrey | 343/873 |
| 2005/0006126 | A1 * | 1/2005 | Aisenbrey | 174/68.1 |

FOREIGN PATENT DOCUMENTS

DE 102 00 051 7/2003

* cited by examiner

*Primary Examiner*—William H Mayo, III
(74) *Attorney, Agent, or Firm*—Young & Thompson

(57) ABSTRACT

A protective sheath against radiation, in particular derived from electric field generated by electric cables (1, 2, 3) extending inside the sheath. The sheath includes an electrically insulating plastic outer layer (4) covering an electrically conductive material layer (5), the sheath end including removable connecting elements for connecting the electrically conductive material layer (5) to an electrical conductor (7) designed to be connected to the ground, the sheath enclosing or designed to enclose at least one neutral cable (1), one ground cable (2) and one phase cable (3) connected to an electric power distribution system.

11 Claims, 6 Drawing Sheets

PROTECTIVE SHEATH AGAINST RADIATION, IN PARTICULAR DERIVED FROM ELECTRIC FIELD GENERATED BY ELECTRIC CABLES

The present invention relates to a protective sheath against radiation, in particular derived from the electric field generated by electric cables extending inside the sheath, for example of the ICTA or ICTL type.

BACKGROUND OF THE INVENTION

So-called "shielded" cables are known which are used in order to transmit high-frequency telecommunications signals either by means of a copper conductor, or by means of an optical fibre, etc. The shielding is generally produced using a braid made of a conductive metal wire which is separated from the conductive wire or from the optical fibre by a layer of insulating plastic material, and is surrounded on the outside by another layer of insulating plastic material.

At present, protective sheaths, called ICTA, ICTL sheaths, etc., are commonly used in the building industry, the external surface of which is smooth or corrugated in order to give them a certain flexibility whilst reinforcing their resistance to deformation. These sheaths have no shielding against radiation, and in particular against the electric fields.

These protective sheaths receive several electric cables, generally a neutral cable, an earth cable and a phase cable connected to the electric distribution network the frequency of which is usually 50 Hz.

The cables are intended to supply power to various devices or power outlets.

These cables generate an electric field which can interfere with certain devices, or even cause health problems.

The aim of the present invention is to remedy these drawbacks by creating a protective sheath against radiation, in particular against the electric field, generated by electric cables of the above type.

SUMMARY OF THE INVENTION

According to the invention, this sheath is characterized in that it comprises an external layer of electrically insulating plastic material which covers a layer made of electrically conductive material, the end of the sheath comprising removable connection means for connecting the layer of electrically conductive material to an electrical conductor intended to be connected to earth, said sheath surrounding or being intended to surround at least one neutral cable, an earth cable and a phase cable connected to the electric distribution network.

The intermediate layer of conductive material connected to earth very greatly attenuates the radiation towards the outside of the electric field generated by the cables extending inside the sheath.

In one embodiment, the conductor intended to be connected to earth extends longitudinally between the conductive layer and an internal insulating layer.

The conductive layer can be a sheet made of conductive metal extending annularly or helically between the external insulating layer and the internal insulating layer. This sheet of conductive metal can be a sheet of aluminium, of mumetal, etc.

However, the layer of conductive material is preferably a polymer loaded with conductive powder such as graphite.

Consequently, the different layers can be coextruded.

Also preferably, the sheath is corrugated on the outside and on the inside, which allows it to be bent and easily cut up as required.

Other characteristics and advantages of the invention will also become apparent in the description below.

BRIEF DESCRIPTION OF THE DRAWINGS

In the attached drawings, given by way of non-limitative examples.

DETAILED DESCRIPTION OF THE PREFERRED EMBODIMENTS

Figure 1:
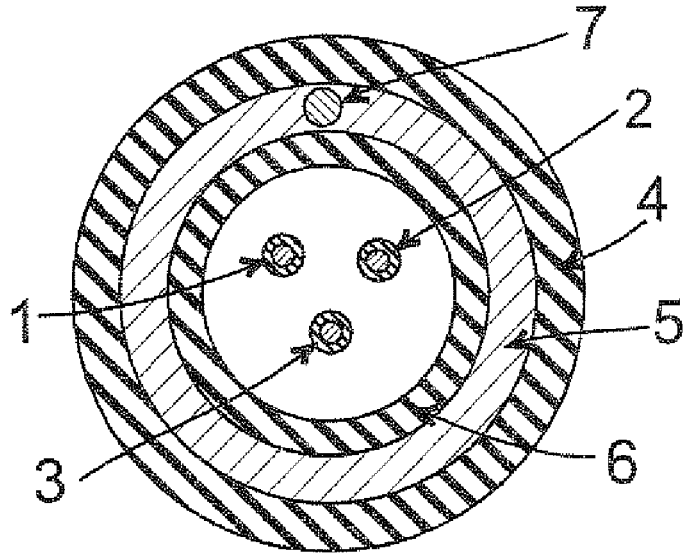
- FIG. 1 is a cross-section view of a first version of an anti-radiation sheath according to the invention.
Figure 2:
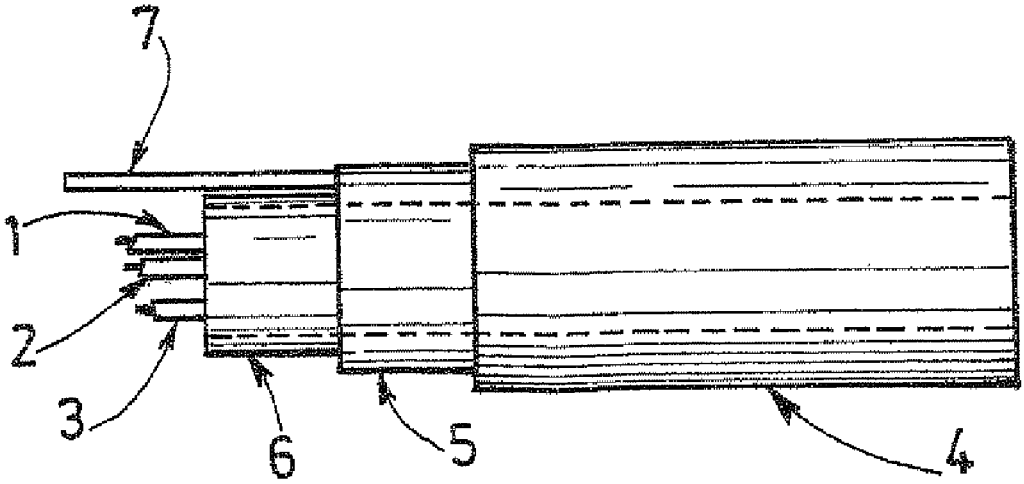
- FIG. 2 is a longitudinal view with cut-aways of the sheath according to FIG. 1.

FIGS. 1 and 2 show a protective sheath against radiation, in particular against the electric field generated by electric cables 1, 2, 3 extending inside the sheath.

The sheath comprises an external layer 4 of electrically insulating plastic material, an intermediate layer 5 of electrically conductive material, an internal layer 6 of electrically insulating material, an electric conductor 7 intended to be connected to earth which is connected to the intermediate layer 5 of conductive material. This sheath surrounds or is intended to surround a neutral cable 1, an earth cable 2 and, at least one phase cable 3 connected to the electric distribution network the frequency of which is usually 50 Hz.

In the example represented the conductor 7 intended to be connected to earth is a bare conductive wire, for example of copper. It extends longitudinally between the conductive intermediate layer 5 and the internal insulating layer 6.

The intermediate conductive layer 5 can be a sheet of conductive metal, such as a sheet of aluminium extending annularly or helically between the external insulating layer 4 and the internal insulating layer 6.

The external and internal insulating layers 4, 6 can be made of a plastic material of the same quality as the standard sheaths currently used in the building industry, such as polypropylene, polyethylene or PVC.

The external diameter of the sheath can vary according to the ranges which currently exist for standard unprotected sheaths.

The thickness of these layers 4, 6 is of the order of 0.1 mm.

The intermediate layer 5, when it is constituted by a sheet of aluminium, can be very thin: approximately $1/100^{th}$ of a mm.

The above sheath can be produced in several stages:

- application onto an internal insulating sheath of a sheet of aluminium then application onto the latter of an external insulating layer.

The sheath can also be produced in a single stage by moulding from a casting or similar.

The sheath could be slit in the direction of its length in order to allow or facilitate the placement of the cables according to the application considered.

FIGS. 3 to 7 represent preferred embodiments of the protective sheath according to the invention. As in the embodiment described previously, the sheath comprises an external layer 4 of an electrically insulating plastic material which covers a layer 5 of electrically conductive material. Moreover, the end of the sheath comprises (see FIGS. 4 and 5) removable connection means for connecting the layer 5 of electrically conductive material to an electric conductor 7 intended to be connected to earth.

Figure 3:
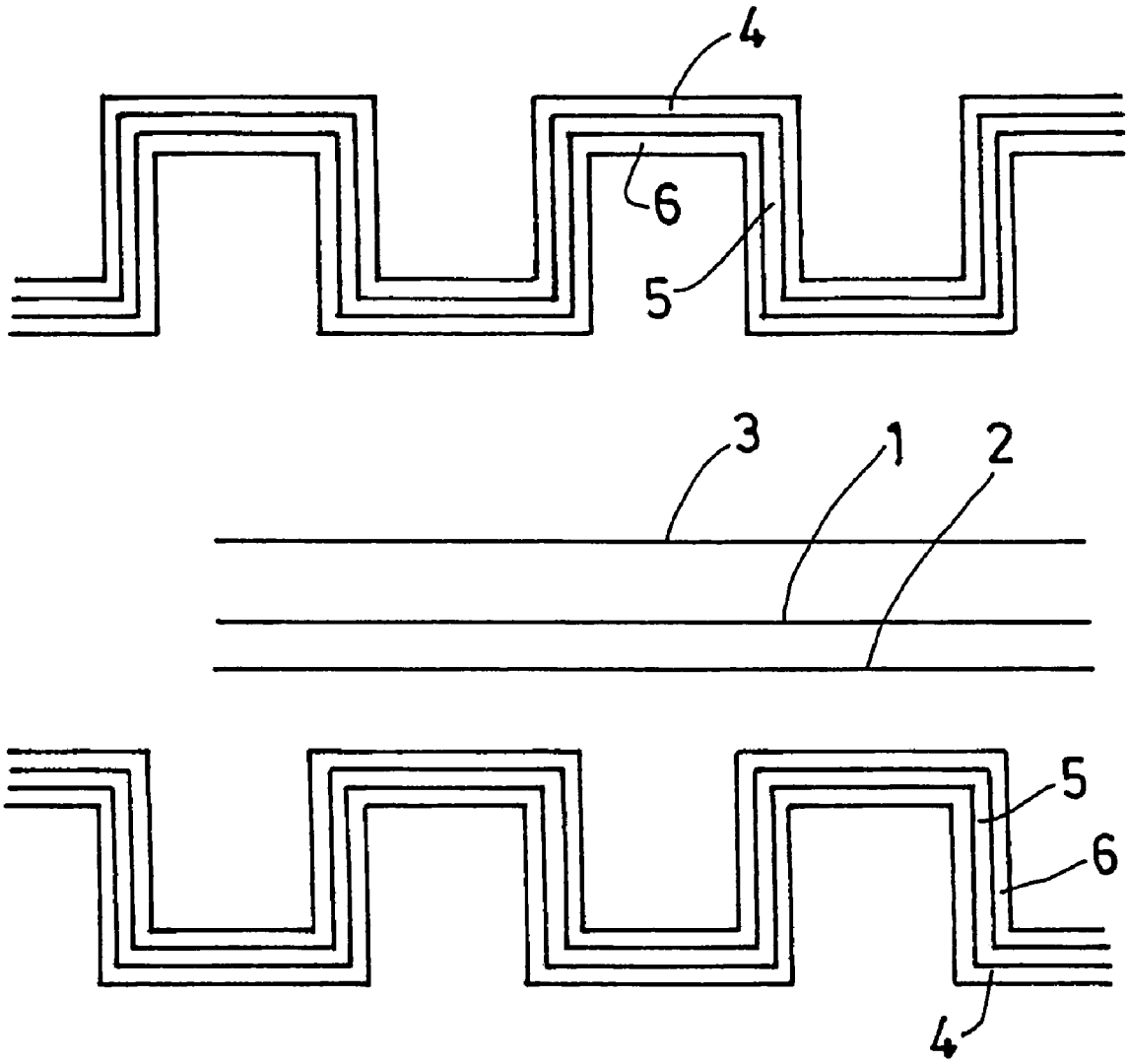
- FIG. 3 is a diagrammatic view in longitudinal section of a sheath according to the invention, corrugated and composed of three layers.
Figure 5:
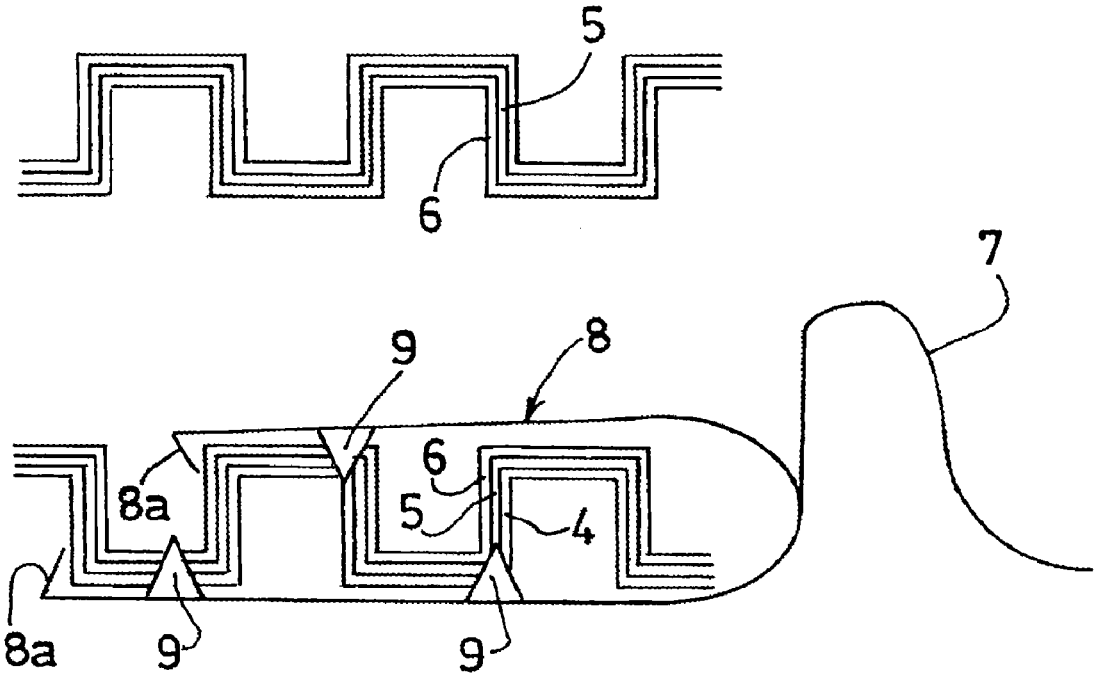
- FIG. 5 is a similar view to FIG. 4, the sheath comprising 3 layers.
Figure 7:
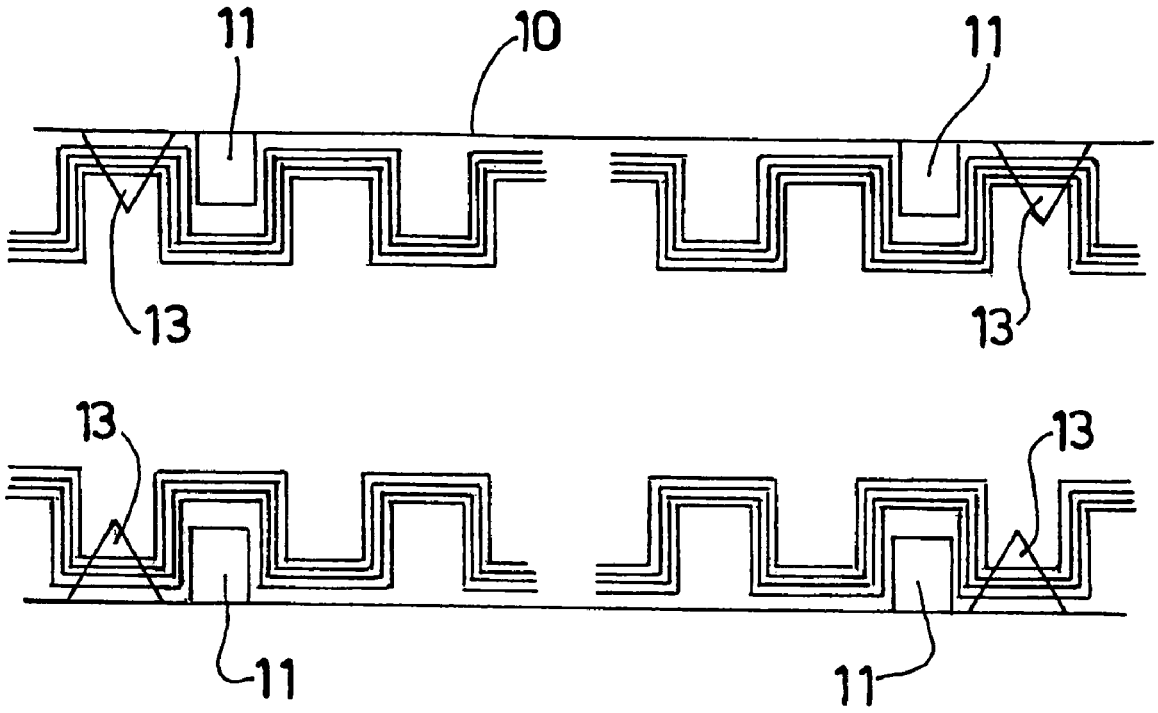
- FIG. 7 is a view similar to FIG. 6, the sheath having three layers.

In these examples, the layer 5 of conductive material is made of polymer loaded with conductive powder, such as graphite. The polymer contains for example, from 5 to 40% graphite. In the example of FIGS. 3, 5 and 7, the layer 5 made of polymer loaded with conductive powder is comprised between the external insulating layer 4 and an internal insulating layer 6.

Figure 4:
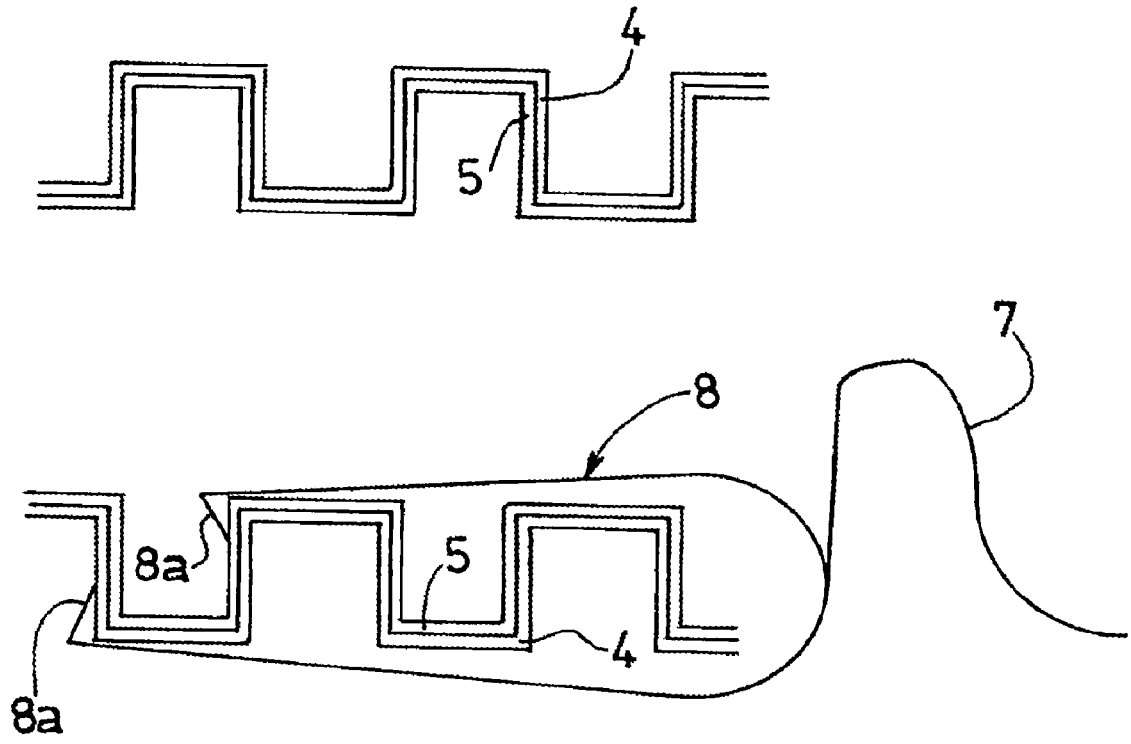
- FIG. 4 is a similar view to FIG. 3, the sheath having two layers and its end comprising a connection clip.
Figure 6:
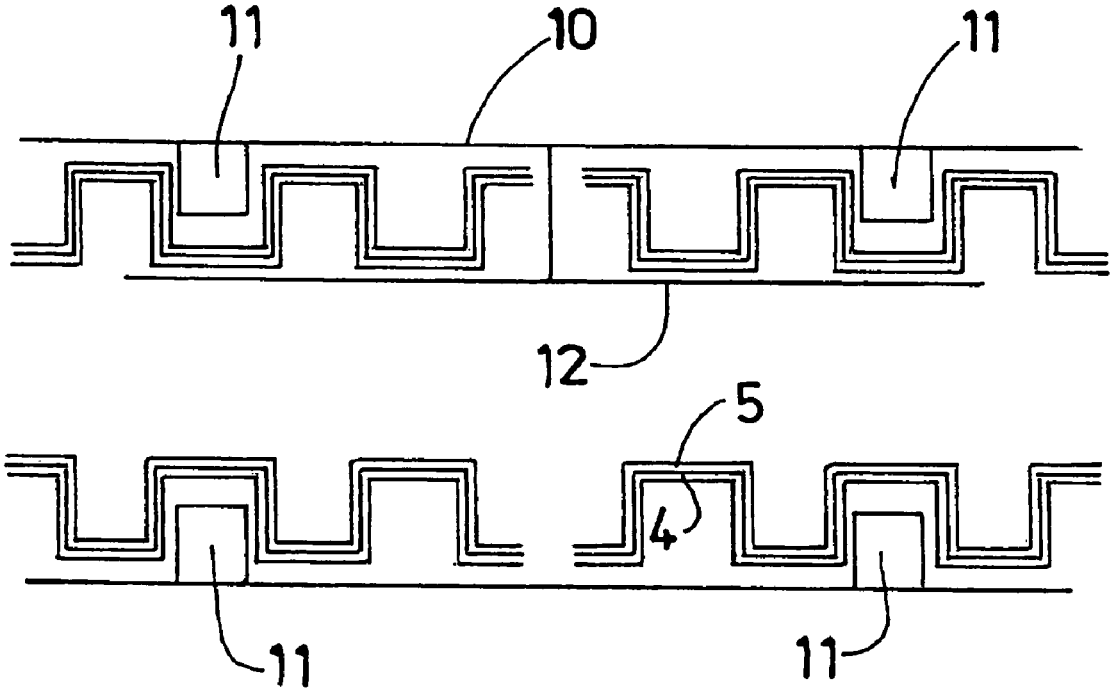
- FIG. 6 is a longitudinal cross-section view of two sections of a sheath with two layers, connected by means of a sleeve.

In the example of FIGS. 4 and 6, there are only two layers. In both cases, the sheath is corrugated on the outside and on the inside, which allows it to be rigid, flexible and easily cut up into sections of desired length.

In the embodiments represented in FIGS. 4 and 5, the removable connection means for connecting the layer 5 of electrically conductive material to an electric conductor 7 intended to be connected to earth include a conductive clip 8 connected to the electric conductor 7 which is able to electrically clip onto one end of the wall of the sheath. The ends of the clip 8 comprise, for this purpose, locking jaws 8*a* which are able to lock onto a ring outside and/or inside the sheath.

In the example of FIG. 4, the sheath is composed of two layers, one of them 4 being insulating and the other 5, being conductive. In this case, the conductive clip 8 is in direct contact with the layer 5 and thus establishes the electric connection with the conductive layer 5.

When the conductive layer 5 is composed of three layers (see FIG. 5) and is situated between two insulating layers 4, 6, the clip 8 comprises, in addition, sharp and pointed wedges 9 which are able to pierce the wall of the sheath in order to establish an electric connection with the conductive layer 5, thanks to the elastic bearing force exerted by the two arms of the clip 8.

In the case of FIGS. 6 and 7, a sleeve 10 is provided in order to connect the ends of two sheath sections. This sleeve 10 is able to engage onto the ends of these two sheath sections, and comprises on its internal surface holding catches 11 which are able to engage between two external rings of each of the two sheath sections.

Means are also provided for establishing the electric connection between the conductive layers 5 of the two sheath sections.

When the sheath is made up of two layers (see FIG. 6), one of them 4 being insulating, and the other 5, being conductive, the above-mentioned connection means comprise a flexible conductor 12 connecting the conductive layers 5 of the two sheath sections together.

When the sheath (see FIG. 7) is composed of three layers, the conductive layer 5 being situated between two insulating layers 4, 6, the connecting sleeve 10 also has, on its internal surface sharp and pointed pins 13, which are able to pierce the wall of each sheath section in order to establish an electric connection between the conductive layers 5 of the two sheath sections.

The sheath which has just been described has the following main advantages:

Thanks to its corrugated structure, the sheath is flexible, bendable and easy to cut up as required.

Moreover, the sheath is impermeable to liquids, in particular water and concrete laitance. It can thus be immersed in concrete.

The preferred sheath according to FIGS. 3 to 7 can be economically produced, from polypropylene for example and by simultaneous coextrusion of several layers.

The sleeve 10 represented in FIGS. 6 and 7, makes it possible to easily connect two sheath sections while ensuring the continuity of the conductive layer.

Moreover, the end clips 8 make it possible to easily connect the conductive layer of the sheath to a conductive wire intended to be connected to earth.

The invention claimed is:

1. A protective sheath against radiation, comprising:

a flexible longitudinal enclosure defining an inside wall, an outside wall, and a terminal end, the enclosure comprised of a conductive layer (5) of electrically conductive material and an external insulating layer (4) of electrically insulating plastic material covering said conductive layer (5); and removable connection means for connecting the conductive layer (5) to an electric conductor (7) connectable to earth, wherein said longitudinal enclosure is configured to surround at least one neutral cable (1), an earth cable (2) and a phase cable (3) connected to an electric distribution network, and wherein the conductive layer (5) is made of polymer loaded with a conductive powder.

2. The protective sheath according to claim 1, wherein the longitudinal enclosure is further comprised of an internal insulating layer (6), the conductive layer (5) surrounding the internal insulating layer (6), and wherein the conductor (7), extends longitudinally between the conductive layer (5) and the internal insulating layer (6).

3. The protective sheath according to claim 1, wherein the conductive powder is graphite.

4. The protective sheath according to claim 1, wherein the longitudinal enclosure is further comprised of an internal insulating layer (6), the conductive layer (5) surrounding the internal insulating layer (6), and wherein the conductive layer (5) is provided between the external insulating layer (4) and the internal insulating layer (6).

5. The protective sheath according to claim 1, wherein both the inside wall and the outside wall of said longitudinal enclosure comprise concentric corrugations along a longitudinal length of said longitudinal enclosure.

6. The protective sheath according to claim 5, wherein the concentric corrugations form concentric rings along the longitudinal length of said longitudinal enclosure, and wherein the removable connection means comprises a conductive clip (8) connectable to said electric conductor (7), the conductive clip (8) comprising ends configured to lock onto one or more of the rings on any of the outside wall the inside wall to elastically clip to the terminal end of the longitudinal enclosure.

7. The protective sheath according to claim 6, wherein the conductive clip (8) is in direct contact with the conductive layer (5) and establishes an electric connection with the conductive layer (5).

8. The protective sheath according to claim 6, wherein the longitudinal enclosure is further comprised of an internal insulating layer (6), the conductive layer (5) surrounding the internal insulating layer (6), wherein the conductive layer (5) is situated between the internal insulating layer (6) and the external insulating layer (4), and wherein said conductive clip (8) further comprises sharp and pointed pins (9) configured to pierce any of the internal insulating layer (6) and the external insulating layer (4) to establish an electric connection with the conductive layer (5).

9. The protective sheath according to claim 5, further comprising:

another longitudinal enclosure defining another terminal end, the end of the longitudinal enclosure defining a first section and the another end of the another longitudinal enclosure defining a second section; and a sleeve (10) comprising an internal surface and holding catches (11) on the internal surface configured to engage between two external rings of each of the longitudinal enclosure and the another longitudinal enclosure to engage onto the first section and the second section, the sleeve further comprising means for establishing electric connection between the conductive layers (5) of the first and second sections.

10. The protective sheath according to claim 9, said means for establishing electric connection comprising a flexible conductor (12) configured to electrically connect the conductive layers (5) of the first and second sections together.

11. The protective sheath according to claim 9, wherein the longitudinal enclosure is further comprised of an internal insulating layer (6), the conductive layer (5) surrounding the internal insulating layer (6), wherein the conductive layer (5) is situated between, the external insulating layer (4) and the internal insulating layer (6), and wherein the sleeve (10) further comprises, on the internal surface, sharp and pointed pins (9) configured to pierce any of the internal insulating layer (6) and the external insulating layer (4) of the first and second sections to establish an electric connection between the conductive layers (5) of the first and second sections.

* * * * *